United States Patent [19]

Seragnoli

[11] 3,983,774

[45] Oct. 5, 1976

[54] APPARATUS FOR PRODUCING A CONTINUOUS SUCCESSION OF WRAPPER SHEETS FOR USE IN A WRAPPING MACHINE

[75] Inventor: Enzo Seragnoli, Bologna, Italy

[73] Assignee: G. D. Societa per Azioni, Italy

[22] Filed: June 18, 1974

[21] Appl. No.: 480,493

[30] Foreign Application Priority Data

Sept. 21, 1973 Italy ..... 3498/73

[52] U.S. Cl. ..... 83/289; 53/64; 53/389; 83/299; 83/303; 83/650

[51] Int. Cl.² ..... B26D 1/40; B26D 5/38; B26D 11/00

[58] Field of Search ..... 83/303, 289, 650, 367, 83/370, 436, 299; 53/64, 389, 168; 242/56 R, 58

[56] References Cited

UNITED STATES PATENTS

| | | | |
|---|---|---|---|
| 1,833,011 | 11/1931 | Aldrich et al. | 53/389 |
| 3,325,071 | 6/1967 | Schmitz | 53/168 UX |
| 3,771,281 | 11/1973 | Witte | 83/650 X |
| 3,789,714 | 2/1974 | Demny | 83/650 X |
| 3,843,253 | 10/1974 | Mikan et al. | 83/650 X |
| 3,871,257 | 3/1975 | Schmermund | 83/303 X |

*Primary Examiner*—Frank T. Yost
*Attorney, Agent, or Firm*—Robert E. Burns; Emmanuel J. Lobato; Bruce L. Adams

[57] ABSTRACT

An apparatus for producing a continuous succession of pieces or sheets, particularly suitable for infeeding cut pieces of wrapping material to wrapping machines, comprises a track for collating and sending forward the said sheets or cuttings; a plurality of auxiliary tracks leading to the said collation track; means for channelling along the auxiliary tracks, successively, wrapping material from respective reels; and control means for rhythmically cutting such material and for automatically feeding material, end to end, from a fresh reel on exhaustion of an empty reel. The control means comprise sensor means for detecting the end of the material from the empty reel; for cutting from the end portion a piece of material equal in length to or a multiple of the length of the said sheets or cuttings and for thereupon causing material to move forward along another of the said auxiliary tracks so that there is a continuous succession of sheets or cuttings along the above mentioned track where the said sheets or cuttings are collated and sent forward.

5 Claims, 3 Drawing Figures

APPARATUS FOR PRODUCING A CONTINUOUS SUCCESSION OF WRAPPER SHEETS FOR USE IN A WRAPPING MACHINE

BACKGROUND OF THE INVENTION

This invention relates to an apparatus for producing a continuous succession of pieces or sheets, particularly suitable for infeeding cut pieces of wrapping material to wrapping machines.

To be more precise, the apparatus according to the invention envisages a fresh, or standby, or second reel automatically replacing a first reel of material when the latter has been used up, without this affecting the continuity in the succession of the sheets or cuttings obtained from the said material wound on to individual reels.

the terms "first" and "second" reel mentioned herein are purely indicative since the positions occupied by the two reels alternate between one and the other depending upon whether the reel is supplying material of if it is acting as the standby reel.

DESCRIPTION OF THE PRIOR ART

According to the known practice in this particular field, the strip or web of wrapping material is unwound from each reel by means which can consist of a pair of rollers known as infeed rollers, the spindles of which are parallel to each other, in close contact with each other. The said strip or web of wrapping material is subsequently divided up into sheets or cuttings of a given length by a cutting device.

When the said sheets or cuttings are required for immediate use, after various transfer operations they are delivered, along with the products to be wrapped, to the actual wrapping machine.

In the known technique for supplying wrapping machines, the problem of replacing a finished reel with a fresh reel has been solved in different ways. Devices have, for example, been perfected for splicing, by means of sealing or gluing members, the final section of the web on the reel that is about to run out to the free end of the new reel, in such a way as to guarantee continuity in the supply of the wrapping material to the wrapping machine.

In this particular case the final section of the material being taken from the first reel serves to move forward the material from the second reel, until it is inserted between the infeed rollers. The splicing is controlled by means which come into action automatically as the material from the first reel is about to come to an end.

An alternative way in which this matter has been solved dispenses with the use of the aforementioned sealing or gluing members and when the material from the first reel is coming to an end, an auxiliary supply system composed of rollers, known as pre-infeed rollers, comes into operation, initially unwinding the material from the standby reel, until the free end has been inserted between the infeed rollers.

This method too guarantees continuity in the supply of the wrapping material since the free end of the material from the new reel arrives at the infeed rollers at a time when the material from the first reel is still sliding between them. As in the previous case, for a certain interval of time two spliced or superposed strips are fed to the single cutting device. However, the spliced strips are not, in the latter case bonded together with glue or by means of sealing or welding.

In harmony with the aforementioned methods, reel change devices have been prepared, equipped either with one auxiliary infeed system connectable with one reel or with the other, or else equipped with two auxiliary independent infeed systems, one per reel.

The system of pre-infeed rollers, in keeping with what has been seen previously, automatically comes into operation at the time each reel runs out.

As a consequence of the foregoing, whilst the known systems guarantee the operational continuity of the wrapping machine during the changeover from one reel to another, they cause the device for cutting the material into pieces and subsequently the wrapping machine too to handle, at the time in question, sections of material which has been spliced and is twice its normal thickness.

The repercussions of this, besides being obviously adverse from a financial point of view, also are such that both the cutting device and the wrapping machine are compelled to operate in an abnormal fashion and handle wrapping material of a mechanical strength above that which is customary.

In addition to an inevitable waste of wrapping material, in the majority of cases it is also necessary, because of their appearance, to reject products wrapped in the said pieces of spliced material, and to replace the rejected products with others taken from a reserve stock.

SUMMARY OF THE INVENTION

The object of the present invention is, therefore, to overcome the aforementioned difficulties by making available an apparatus of the type to which reference has been made above, suitable to be connected to a wrapping machine and able to automatically cause an empty reel to be replaced with a fresh reel without any interruption in the operation of the wrapping machine and, furthermore, to allow, whilst the replacement operation is in progress, the cutting means and the wrapping machine itself to operate under perfectly normal conditions without there being any waste of material or any need to provide, for the reasons previously seen, rejection devices below the wrapping machine.

The new apparatus produces, from successive webs of material, a continuous succession of pieces or sheets, particularly suitable for infeeding cut pieces of wrapping material to wrapping mcahines. The apparatus comprises a track for collating and sending forward the said sheets or cuttings; a plurality of auxiliary tracks leading to the said collation track; means for channelling along the auxiliary tracks, successively material from respective reels. According to the invention the apparatus has control means for rhythmically cutting such material for automatically feeding material, end to end, from a fresh reel on exhaustion of an empty reel. The control means comprise sensor means for detecting the end of the material from the empty reel. It is an essential features of the new apparatus that the control means enable cutting from the end of the initial web of a piece material equal in length to, or a multiple of, the length one of the said sheets or cuttings and to thereupon cause material to move forward along another of the said auxiliary tracks so that there is a continuous succession of sheets or cuttings along the above mentioned track where the said sheets or cuttings are collated and sent forward. The control means enable operating the infeed means belonging to the track ending at the standby reel in such a way that the wrapping material from that reel is delivered to the main track, after the end of the material from the empty reel, so that also in the transition from one reel to the other an unbroken sequence of wrapping material in the form of cuttings is fed to the wrapping machine.

BRIEF DESCRIPTION OF THE DRAWINGS

Further characteristics and advantages will emerge more clearly from the following detailed description of certain preferred forms of embodiment for the apparatus according to the invention, illustrated as non-limiting examples on the accompanying drawings in which.

DESCRIPTION OF THE PREFERRED EMBODIMENT

Figure 1:
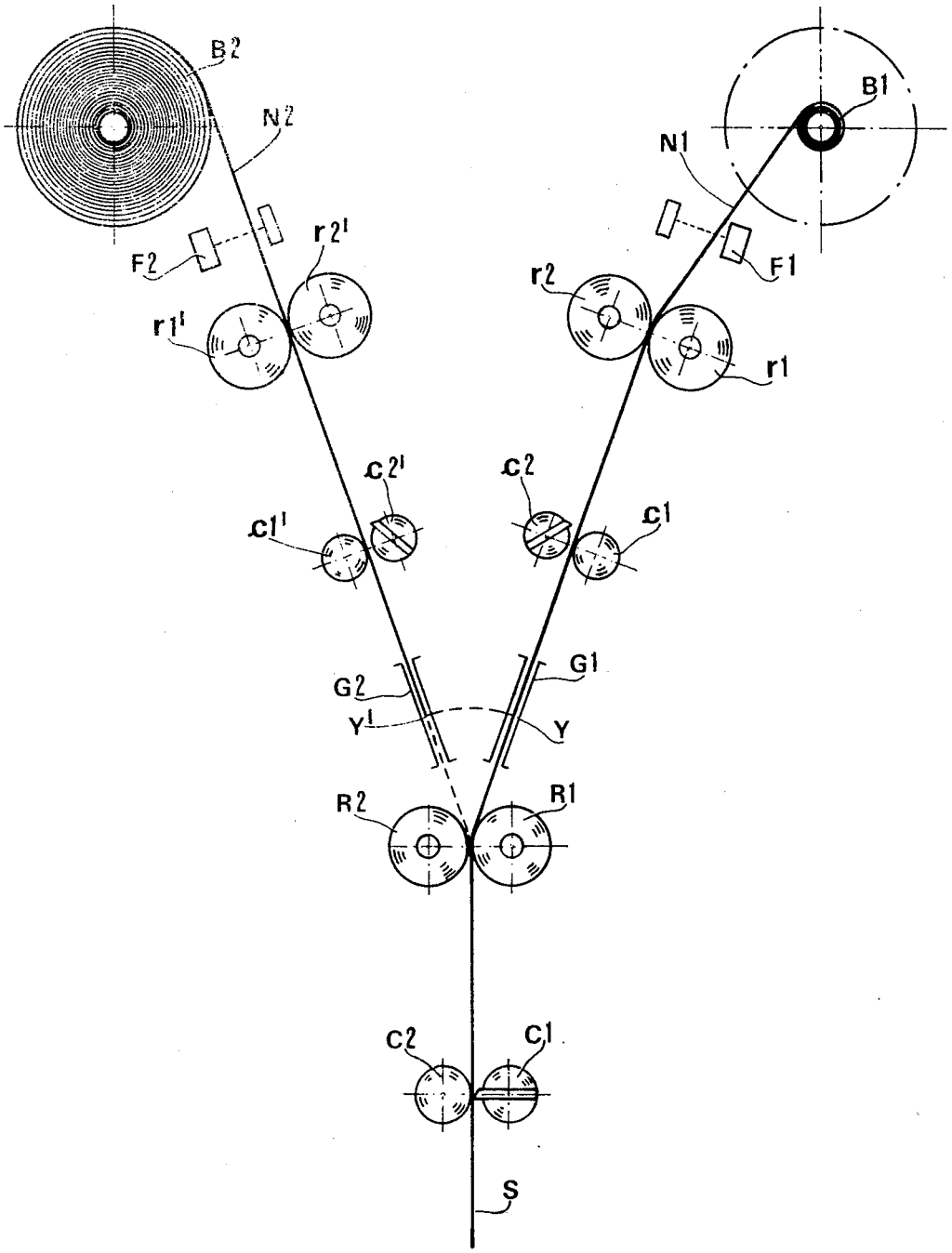
FIG. 1 shows a front view in diagrammatic form, of the apparatus according to a first embodiment of the invention.

With reference to FIG. 1, at B1 there is a first reel of wrapping material mounted in a rotatable fashion on a horizontal spindle, from which the material N1 is unwound by a pair of infeed rollers R1 and R2 mounted on horizontal parallel spindles.

Below the rollers R1 and R2 a cutting device operates and this consists of a roller C1 provided with a blade which operates in conjunction with a counter-roller C2, the task of this assembly being to divide the continuous strip of material N1 up into the cuttings S for them to be utilized by a wrapping machine not shown on the drawing.

The infeed rollers R1-R2 and the rotating knives C1-C2 define a vertical infeed track for the wrapping material and this lies on a plane hereinafter referred to as the main plane or track and represents, in the particular form of embodiment described herein, a plane of symmetry for the complete device.

Two rollers r1 and r2 mounted on horizontal parallel spindles are postioned immediately below the reel B1 and these, which work on conjunction with each other, have the task of acting as a system for the auxiliary infeed or pre-infeed of the material N1 from the reel B1.

In conjunction with the rollers R1 and R2, the said pre-infeed rollers r1 and r2 define, in turn, a plane or pre-infeed track for the material N1 from the reel B1 which is not coincident with the above mentioned main plane or track.

Between the said pre-infeed rollers *r1* and *r2* and the reel B1 a sensor device F1 is provided and this detects the end of the material N1 from the said reel B1, whilst below the said rollers r1 and r2, along the said pre-infeed track, an auxiliary cutting device consisting of a roller *c2* provided with a blade and operating in conjunction with a counter-roller c1 is positioned. Additionally along the pre-infeed track for the material N1, in the area in between the device c1-c2 and the rollers R1 and R2 a fixed guide G1 is placed and the function of this will be seen in due course.

A second reel B2 of material N2 referred to hereinafter as the new or reserve reel is mounted in a position symmetrical to the first reel B1 with respect to the main infeed plane. Two rollers *r1'* and *r2'* constitute the auxiliary infeed system for the reel B2, whilst at c2' there is a roller provided with a blade and this, in conjunction with a counter-roller *c1'*, infeeds the material N2.

In conformity with what has already been stated for the two reels, the rollers *r1'* and *r2'* are mounted symmetrically to the pre-infeed rollers r1 and r2 of the reel B1 with respect to the main infeed plane, whilst the cutting system *c1'* and *c2'* is symmetrical to the cutting system *c1* and *c2* for the material N1, with respect to the said plane. The same applies for a fixed guide G2 in relation to the aforementioned guide G1 and for a sensor device F2 in relation to the sensor device F1.

As a consequence of this, the pre-infeed track for the reel B2, defined by the pre-infeed rollers r1' and r2' in conjunction with the main infeed rollers R1 and R2, is symmetrical with the pre-infeed track for the reel B1, with respect to the main infeed plane.

Figure 2:
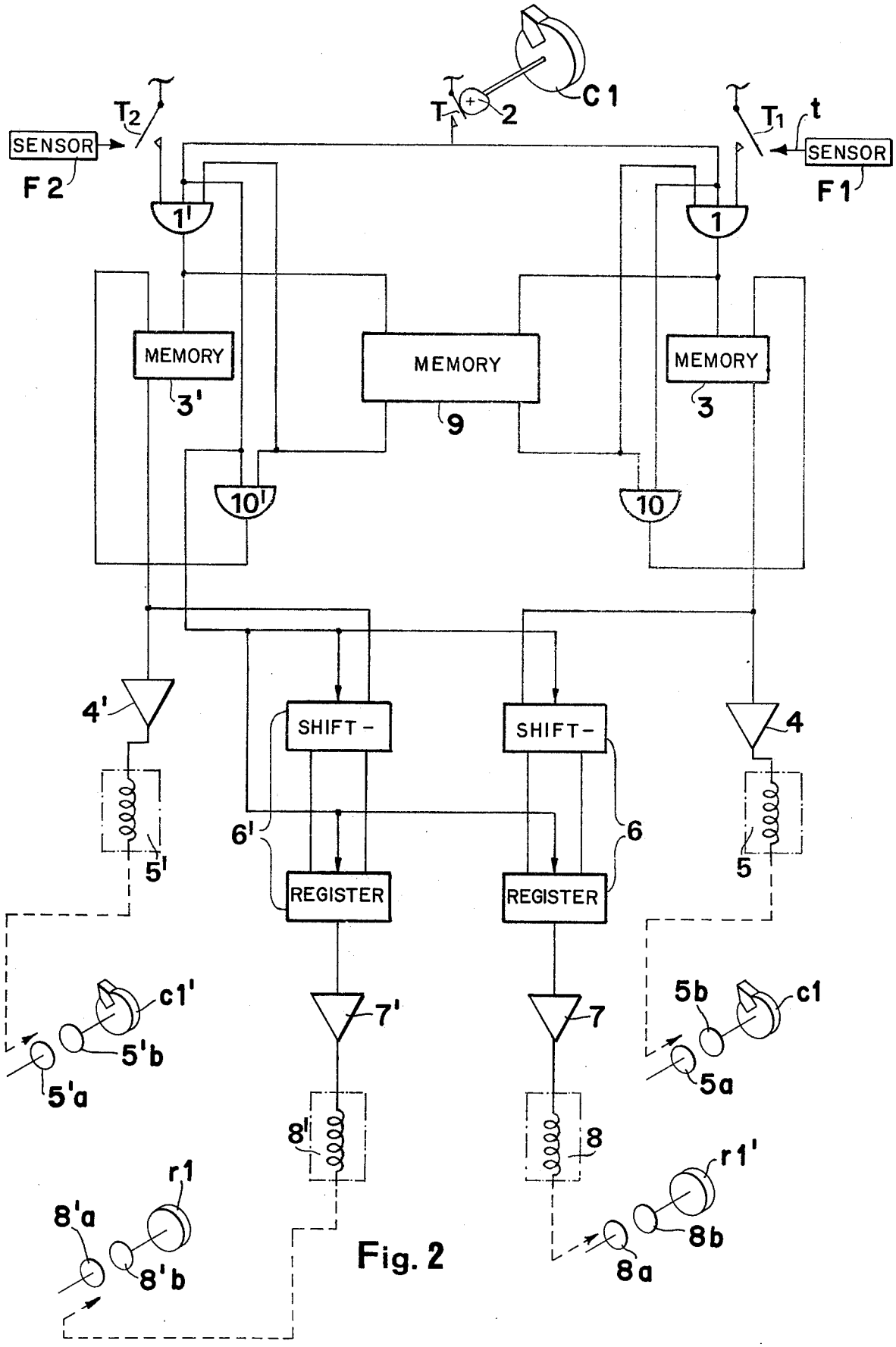
FIG. 2 schematically shows the electrical control circuit for the said first embodiment.

Up until now a description has been given of the structural layout of the essential units constituting one particular form of embodiment for the apparatus according to the invention and now its operation, also with reference to the electrical diagram in FIG. 2 will be examined.

Assuming the apparatus to be working under normal operating conditions, the infeed rollers R1 and R2, one at least of which is a driven roller, unwind the material N1 from the reel B1 and feed it to the cutting device C1 and C2 which divides the said strip of material up into cuttings S of a predetermined length.

Under these conditions the two auxiliary infeed rollers *r1* and *r2* rotate loosely around their spindles moved by friction by the material N1, whilst the cutting device *c1* and *c2* is in the reset position and the blade fitted to the roller c2 is rotated at a certain angle away from the infeed path for the material N1.

As the reel B1 continues to be unwound, the material N1 wound thereon gradually decreases until it comes completely to an end, that is to say, until it separates from the reel carrier spindle and when this occurs the sensor device F1 causes the contact T1 to close (see FIG. 2) through connections to which are well known by themselves.

The impulse of current generated by the closing of the contact T1 is sent to a first input on the AND gate 1.

The AND gate 1 is provided with a second input energized through the closing of a contact T. This latter contact T is cyclically closed after each complete revolution, that is to say, after each 360° of rotation, of a cam 2 keyed on to the spindle of the main cutter roller C1. The simultaneous occurrence of the two events, that is to say, the presence of two impulses of current on the inputs of the AND gate 1 generates a signal in the output circuit of this gate, in a way known by itself. This signal, duly memorized and amplified by a memory 3 and an amplifier 4, respectively, is used to operate, for example, by engaging a clutch 5 having discs *5a*, *5b*, the auxiliary cutting device *c1–c2* belonging to the reel B1.

The operation of the auxillary cutting device *c1–c2*, controlled in the way seen above, is regulated so as to detach from the material N1 on the finished reel B1 a final piece of a length L which is a multiple of the length l of each individual cutting S; that is to say, L = nl.

This is done, for example, by suitably regulating the position of the blade c1 of the device c1-c2 with respect to the infeed plane of the reel B1, in such a way that the cut is made at the required point, in keeping with the ratio indicated above.

The final detached section of the material N1, having length L and drawn along by the infeed rollers R1 and R2 is cyclically divided by the cutting device C1-C2 into *n* cuttings S which are thus fully utilizable by the wrapping machine.

In order, however, that below the cutting device C1-C2 there be an unbroken and uniform succession of cuttings S from material on the main infeed track, even at the time the operation of replacing one reel B1 with the other B2 is being carried out, there must be continuity in the delivery of the materials N1, N2 (that is to say, it must follow N1 without any pause and also without any superposition).

Assuming, for reasons of simplicity, that the infeed speed of the rollers R1 and R2 is equal to that of the rollers *r*1′ and *r*2′ and bearing in mind that the structure of the device is symmetrical, it is necessary, in order to achieve the above mentioned conditions, that once the free end of the material N2 has been fastened in a suitable position Y′ on the infeed track guide G2 of the reserve reel B2, this material starts to move at the very moment when the final extremity of the material N1 passes, on the infeed track of the reel B1, into the corresponding position Y symmetrical with Y′.

In this way, at the point where the infeed track for the material on the reel B1 converges with that for the material on the reel B2, the free end of the material N2 will follow on immediately after the final extremity of the material N1.

It should be noted that in consequence of what has been said in connection with the dimension L of the final detached section of the material N1, the cutting devicd C1–C2 will operate once without cutting anything between the last cutting S of the material N1 and the free end of the material N2.

With this particular form of embodiment for the apparatus forming the subject of the present invention, the foregoing is achieved by picking up the signal for operating the cutting device *c*1–*c*2 at the output of the memory 3 and by sending it to the first element or cell of a shift register 6, the shift signal for which is additionally generated by the cyclic closing of the contact T by the cam 2.

When the leading edge of the final detached piece of the material N1 passes into the position Y, the signal from the output of the shift register 6, duly amplified by an amplifier 7, is sent forward to operate, through the engagement of a clutch 8 having discs 8*a*, 8*b*, the auxiliary infeed device *r*1′–*r*2′ belonging to the reel B2.

The number of steps for the above mentioned shift register 6, which in this particular instance is two, represents, in cycles, the time lag established for the commencement of the infeeding of the material N2 with respect to the instant when the auxiliary cutting device *c*1–*c*2 operates.

Since it is advisable, for various reasons, to position the free leading end of the material N2 in the proximity of the infeed rollers R1 and R2, not only will the number of steps depend on the distance between the cutting device *c*1–*c*2 and the rollers R1 and R2 but also on the length l of the cuttings S.

The free leading end of the material N2 is pushed by the rollers *r*1′–*r*2′ from the position Y′ through the guides G2 in such a way that it is inserted between the infeed rollers R1 and R2 without any discontinuity with respect to the final extremity of the detached material N1.

When the reel B2 comes to an end, the procedure described above is repeated but, as is understandable from the symmetry of the apparatus and from the electrical control circuit, in this particular case the devices concerned are the sensor device F2, the cutting device *c*1′–*c*2′, the auxiliary infeed rollers *r*1–*r*2 and the electrical devices corresponding thereto (see FIG. 2).

In addition to the devices already mentioned, the electrical control circuit is also provided with a magnetic memory 9 for setting the operation of the apparatus on the first or on the second reel, as well as two erasing circuits comprising AND gates 10, 10′, which circuits end at the memories 3 and 3′, respectively.

The new apparatus can easily be set to operate in the case of strips of material to be divided up into cuttings of a length l′ that differs from l since it is structurally independent of the dimensions of the cuttings S. Besides suitably regulating the cutting frequency of the main cutting device C1–C2, all that has to be done to achieve this is to vary the initial conditions of the auxiliary cutting devices *c*1–*c*2 (*c*1′–*c*2′) and correspondingly to displace the position Y′ (Y), that is to say, the position in which the free end of the material N2 (N1) is fastened.

It should be noted that in the particular form of embodiment described above for the apparatus according to the invention, the same signal generated cyclically by the cam 2 is used both for operating the auxiliary cutting systems *c*1–*c*2 and *c*1′–*c*2′ and for the auxiliary infeed systems *r*1–*r*2 and *r*1′–*r*2′.

The choice of a different signal for the operation of the said infeed systems generated, for example, by the rotation of a second cam keyed to the same spindle on which the cam 2 is mounted but at a different angle thereto can allow the free end of the material on the reserve reel to be in a fixed position, that is to say, in a position Y′ (Y) independent of the dimensions of the cuttings S.

In a second form of embodiment for the apparatus according to the invention, a single cutting device is envisaged and this is located at the point where the tracks from the two reels converge.

Under normal operating conditions the said cutting device performs the operations carried out by the previously examined device C1–C2 but when the reel B1 comes to an end, it receives from the usual sensor device instructions to cut the final piece of the material N1 and thus on this occasion does what is done in the main form of embodiment by the device *c*1–*c*2.

The free end of the material N2 pushed by means operated in identical ways to those already seen will follow on after the final extremity of the material N1 through the said cutting device so that there is an unbroken sequence of cuttings.

Figure 3:
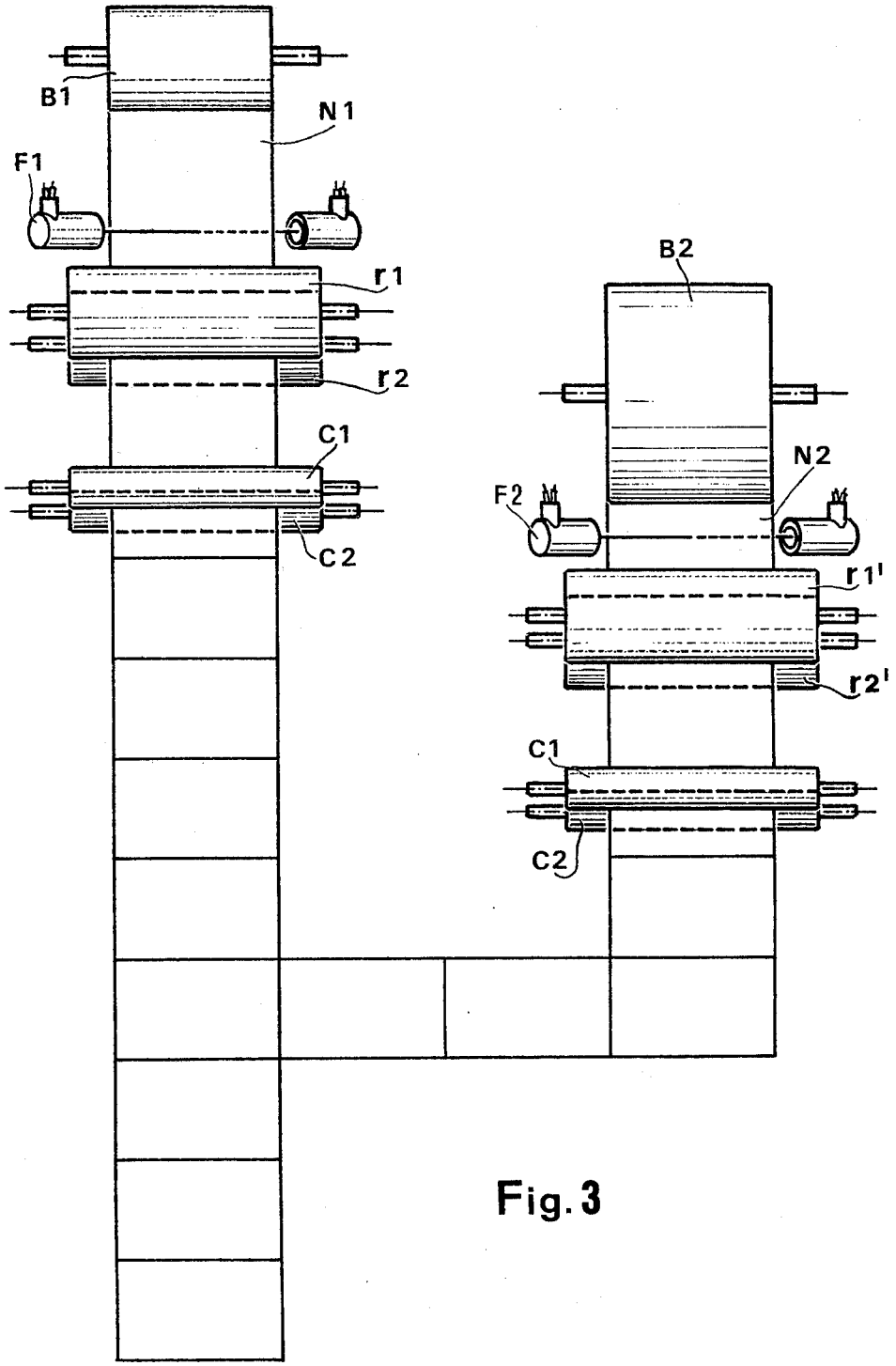
FIG. 3 shows a plan view, in diagrammatic form, of a further embodiment of the invention.

A third form of embodiment for the apparatus according to the invention (see FIG. 3) envisages two cutting devices C1–C2, one placed along the track from the reel B1 and the other along the track from the reel B2, that is to say, it envisages the presence of cuttings S preformed prior to the point where the two tracks converge. The means *r*1–*r*2 attend to the unwinding of the material from the reel B1 whilst the respective cutting device C1–C2 divides the material N1 up into cuttings S which are supplied by transfer means that move forward in an intermittent fashion to the main track, which also moves intermittently, at a speed to suit the speed at which they are used up by the wrapping machine.

When the reel B1 comes to an end, the sensor device F1 signals instructions to the device C1–C2 to cut the final piece of the reel B1. Signals are sent by the said sensor device, timed to suit the operation of the corresponding units belonging to the reel B1, to set the rollers *r1'–r2'* in motion so as to unwind a reserve reel B2, to the cutting device C1–C2 and to the means for moving the track of the reel B2.

The operation of the aforementioned means whose operating characteristics are the same as those used for the reel B1 is such that, in conformity with what has also been seen for the previous forms of embodiment, the final piece cut off the reel B1 is followed at the entrance to the main infeed track by the first piece cut off the reel B2, without there being any superposition and in such a way as to guarantee the infeed continuity to the wrapping machine.

An operating condition for this third form of embodiment as briefly described above and illustrated in FIG. 3 is for the cutting devices to be arranged along the auxiliary tracks at the same number of cycles or steps from the point where the said auxiliary tracks converge.

I claim:

1. Apparatus for making wrapper sheets for use in a wrapping machine, comprising;

feeder means for alternately delivering a first web of sheet material from a first source of such material and a second web of such material from a second source thereof via a first path and a second path respectively to an inlet end of a principal path whereto the first and second paths converge, to deliver successive wrapper sheets via the principal path, the feeder means including first and second feeders located adjacent the first and second paths respectively and each disposed to feed a leading portion of the respective web, incident to the delivering of the other web, from the respective source along the respective path and to stop the leading portion in a starting position thereof with a leading edge at a point of the respective path adjacent the inlet end of the principal path;

cutter means comprising a principal cutter located adjacent the principal path for producing the successive wrapper sheets from either web of sheet material, and first and second auxiliary cutters located respectively adjacent the first and second paths, each for cutting a final portion of sheet material from the respective web when the respective web is nearly exhausted; and control means for controlling the feeder means and cutter means to maintain a continuous and uniform stream of the wrapper sheets travelling over the principal path in succession to one another and free of mutual overlapping during a transition to the delivering of the other web as well as during the delivering of either web from the respective source, comprising, (a) a primary control controlled by the principal cutter to time the feeder means in synchronism with the principal cutter, (b) first and second transition controls associated with the first and second auxiliary cutters respectively and each including a sensor adjacent the respective path, between the respective source of sheet material and the respective auxiliary cutter, for sensing that the source is nearly exhausted, and for thereupon activating said respective auxiliary cutter to then detach a final wrapping sheet at a trailing edge thereof, from a final portion of the nearly exhausted web which travels over the respective path, while activating the feeder means to begin delivering the other web with its leading edge following said trailing edge into the principal path, and (c) memory and shift register means for enabling the feeder means to time the feeding of the webs so as to maintain the continuous and uniform stream of wrapper sheets while enabling the principal cutter to operate at variable speeds and thereby to cut the travelling web into successive sheets of variable length.

2. Apparatus according to claim 1 wherein each transition control includes an AND gate having at least two inputs controlled respectively by the respective sensor and by the principal cutter, and having an output controlling the respective auxiliary cutter.

3. Apparatus according to claim 1 in which the control means include first and second guide means located respectively on the first and second paths for establishing said starting position of the first and second web respectively.

4. Apparatus according to claim 1 in which the feeder means includes principal feeder means located adjacent a portion of the principal path which follows directly downstream of the inlet end, for the feeding of the webs, alternately, onto the principal path; the control means including means for controlling the first and second feeders alternately to effect the feeding of a web to the starting position.

5. Apparatus according to claim 1 in which the control means comprises means for alternately performing a. a first cycle of detecting exhaustion of the first source, and thereupon operating the cutter means to detach at least one final wrapping sheet from the resulting residue of the first web and thereby to establish a trailing edge of the final wrapping sheet, while operating the feeder means to initiate feeding of the second web from said starting position onto the principal path to travel along the same and to discontinue the feeding of the first web when said trailing edge passes a point on the first path adjacent the principal path and corresponding to said point on the second path, and b. a second cycle of detecting exhaustion of the second source and thereupon operating the cutter means and feeder means in a way corresponding with their operation during the first cycle but with respect to cutting the second web, initiating feeding of the first web and discontinuing feeding of the second web.

* * * * *